US007780439B2

(12) United States Patent
Alipour et al.

(10) Patent No.: US 7,780,439 B2
(45) Date of Patent: Aug. 24, 2010

(54) KILNS FOR THE PROCESSING CERAMICS AND METHODS FOR USING SUCH KILNS

(75) Inventors: Ehsan Alipour, San Francisco, CA (US); Alex Shullman, San Francisco, CA (US); Eric Schultz, Palo Alto, CA (US); Benjamin T. Mino, Chicago, IL (US); Mike Strasser, Lafayette, CA (US); Thomas King, San Francisco, CA (US); Clinton N. Slone, Mountain View, CA (US)

(73) Assignee: Duncan Enterprises, Fresno, CA (US)

( * ) Notice: Subject to any disclaimer, the term of this patent is extended or adjusted under 35 U.S.C. 154(b) by 703 days.

(21) Appl. No.: 11/280,953

(22) Filed: Nov. 16, 2005

(65) Prior Publication Data

US 2006/0121404 A1 Jun. 8, 2006

Related U.S. Application Data

(60) Provisional application No. 60/628,693, filed on Nov. 17, 2004.

(51) Int. Cl.
*F27B 3/22* (2006.01)

(52) U.S. Cl. ..... 432/201; 219/390; 126/529

(58) Field of Classification Search ..... 432/248, 432/195, 196, 199, 201, 202, 203; 219/390, 219/385, 405, 420, 421, 428, 438; 126/526, 126/528, 529, 531, 533, 109, 21 A
See application file for complete search history.

(56) References Cited

U.S. PATENT DOCUMENTS 1,751,008 A * 3/1930 La France ..... 432/238
3,825,723 A * 7/1974 Roeser ..... 219/401
4,139,340 A * 2/1979 Bartel ..... 432/179
4,180,049 A * 12/1979 Carr et al. ..... 126/21 A (Continued)

FOREIGN PATENT DOCUMENTS

DE 7704066 U 5/1977

(Continued)

OTHER PUBLICATIONS

International Search Report dated Mar. 31, 2006 for PCT/US2005/041811, 4 pages.

(Continued)

*Primary Examiner*—Gregory A Wilson
(74) *Attorney, Agent, or Firm*—Perkins Coie LLP

(57) ABSTRACT

Kilns for processing ceramics and methods for using such kilns are disclosed herein. In one embodiment, a kiln includes an inner body configured to hold one or more ceramic workpieces for processing. The kiln can also include an outer body at least partially surrounding the inner body and spaced apart from the inner body to define an airflow passageway therebetween. The airflow passageway includes an inlet proximate to an upper portion of the outer body and an outlet proximate to a lower portion of the outer body. The kiln can further include an air mover positioned to move air through the airflow passageway from the inlet toward the outlet. In several embodiments, the kiln can additionally include a lid assembly pivotably coupled to the outer body and configured to sealably close against at least the inner body.

37 Claims, 7 Drawing Sheets

U.S. PATENT DOCUMENTS

| | | | | | |
|---|---|---|---|---|---|
| 4,215,265 | A * | 7/1980 | White | 219/390 |
| 4,361,131 | A * | 11/1982 | Homolik | 126/522 |
| 4,692,593 | A * | 9/1987 | Chiu | 219/401 |
| 4,818,398 | A * | 4/1989 | Lott et al. | 210/238 |
| 4,940,408 | A * | 7/1990 | Ogura et al. | 432/137 |
| 5,378,144 | A * | 1/1995 | Cress | 432/120 |
| 5,477,029 | A * | 12/1995 | Skutt et al. | 219/390 |
| 5,734,149 | A * | 3/1998 | Skutt et al. | 219/390 |
| 6,328,561 | B1 * | 12/2001 | Hasper et al. | 432/238 |
| 6,344,637 | B2 * | 2/2002 | Lee et al. | 219/757 |
| 6,393,044 | B1 * | 5/2002 | Fishman et al. | 373/138 |
| 6,528,774 | B2 * | 3/2003 | Lee | 219/757 |
| 6,619,952 | B2 * | 9/2003 | Hohenshelt et al. | 432/76 |
| 7,011,510 | B2 * | 3/2006 | Nakai et al. | 425/78 |
| 2001/0004077 | A1 * | 6/2001 | Lee et al. | 219/757 |

FOREIGN PATENT DOCUMENTS

| | | |
|---|---|---|
| DE | 3313165 | 11/1984 |
| DE | 29600841 U | 3/1996 |
| GB | 1466999 | 3/1977 |

OTHER PUBLICATIONS

"Standard Practice for Determination of Skin Contact Temperature from Heated Surfaces Using a Mathematical Model and Thermesthesiometer," Designation: C 1057-03, ASTM International, Apr. 23, 2004, 6 pages.

"Standard Guide for Heated System Surface Conditions that Produce Contact Burn Injuries," Designation: C 1055-03, ASTM International, Apr. 23, 2004, 8 pages.

Dax, Mark, "Laboratory Ovens Move into New Realms," Product Roundup, R&D Magazine, Nov. 1997, pp. 49-50, 52 and 54.

"Announcing the Paragon Home Artist a Portable, Fast, Fun Kiln," 2002 Paragon Industries, Inc., 3 pages.

"Production Kiln Line," 1996 Skutt Ceramic Products, Inc., 2 pages.

Chinese Office Action; Chinese Patent Application No. 200580039262.8; Filed: Nov. 17, 2005; Applicant: Duncan Enterprises; Mailed on: Jan. 9, 2009.

European Office Action; European Patent Application No. 05849680.3; Filed: Nov. 17, 2005; Applicant: Duncan Enterprises; Mailed on Jun. 10, 2008.

* cited by examiner

KILNS FOR THE PROCESSING CERAMICS AND METHODS FOR USING SUCH KILNS

CROSS-REFERENCE TO RELATED APPLICATION

The present application claims priority to U.S. Provisional Application No. 60/628,693, filed Nov. 17, 2004, and incorporated herein in its entirety by reference.

TECHNICAL FIELD

The present invention is directed generally toward kilns for processing ceramics and, more particularly, to portable kilns for use in the home environment.

BACKGROUND

Kilns can be used to harden, burn, and/or dry a number of different materials. In one common application, for example, kilns are used in the production of ceramics. This process, generally referred to as "firing," can include chemically refining clay objects by heating them until a crystalline matrix of silica and alumina forms, thus making the resulting ceramic articles hard and durable. Depending on the size, complexity, and desired finish of the ceramic articles, this process can take a significant amount of time.

To fire a ceramic workpiece in a kiln, the temperature of an internal processing chamber is raised to a relatively high temperature (e.g., over 1800° F.), maintained at that temperature for a given period of time to adequately heat the clay object until the clay develops the desired properties, and then cooled relatively quickly so that the ceramic workpiece can be retrieved from the processing chamber and the kiln can be used to process another workpiece. Because of the high temperatures involved, conventional kilns typically include relatively thick insulating sidewalls and extensive cooling systems. As a result, these kilns are large and cumbersome, relatively expensive, and generally unsuitable for home or personal use. Moreover, the exterior surfaces of such kilns can still become relatively hot during operation, thus making the kilns undesirable for in-home or personal use.

SUMMARY

The following summary is provided for the benefit of the reader only and does not limit the invention. Aspects of the invention are directed generally to portable kilns or other types of kilns for processing ceramics. A kiln configured in accordance with one embodiment of the invention includes an inner body configured to hold one or more ceramic workpieces for processing. The kiln can also include an outer body at least partially surrounding the inner body and spaced apart from the inner body to define an airflow passageway therebetween. The airflow passageway includes an inlet proximate to an upper portion of the outer body and an outlet proximate to a lower portion of the outer body. The kiln can further include an air mover positioned to move air through the airflow passageway from the inlet toward the outlet. In several embodiments, the kiln can additionally include a lid assembly pivotably coupled to the outer body and configured to sealably close against at least the inner body.

A kiln configured in accordance with another embodiment of the invention includes an inner body configured to hold one or more ceramic workpieces for processing, and an outer body spaced apart from the inner body to define an airflow passageway therebetween. The airflow passageway includes an inlet proximate to an upper portion of the outer body and an outlet proximate to a lower portion of the outer body. The kiln can also include a lid assembly operably coupled to the outer body and configured to sealably close against at least the inner body. The kiln can further include a radiant barrier positioned in the airflow passageway between the inner body and the outer body, and a fan positioned proximate to the lower portion of the outer body. The fan is positioned to move air through the airflow passageway from the inlet toward the outlet to cool the inner body during processing of the ceramic workpieces.

A method for processing ceramics in accordance with a further aspect of the invention includes placing a ceramic workpiece into a processing chamber of a kiln and increasing the temperature in the processing chamber to process the ceramic workpiece. The method can also include flowing air from an inlet positioned proximate to an upper portion of the kiln through a passageway extending at least partially around the processing chamber to maintain the temperature of an exterior portion of the kiln at or below a preset temperature. In several embodiments, the method can further include reflecting at least a portion of the heat generated by the processing chamber back toward the inner body using a radiant barrier positioned in the airflow passageway.

DETAILED DESCRIPTION

The following disclosure describes various aspects of kilns and other heating devices for processing ceramics, glazes, and/or other related materials. Certain details are set forth in the following description and in FIGS. 1A-5 to provide a thorough understanding of various embodiments of the invention. Well-known structures, systems and methods often associated with kilns and related systems, however, have not been shown or described in detail below to avoid unnecessarily obscuring the description of the various embodiments of the invention. Any dimensions, angles, and other specifications shown in the Figures are merely illustrative of particular embodiments of the invention. Accordingly, other embodiments of the invention can have other dimensions, angles, and specifications without departing from the spirit or scope of the present disclosure. In addition, those of ordinary skill in the relevant art will understand that additional embodiments of the invention may be practiced without several of the details described below.

Figure 1A:
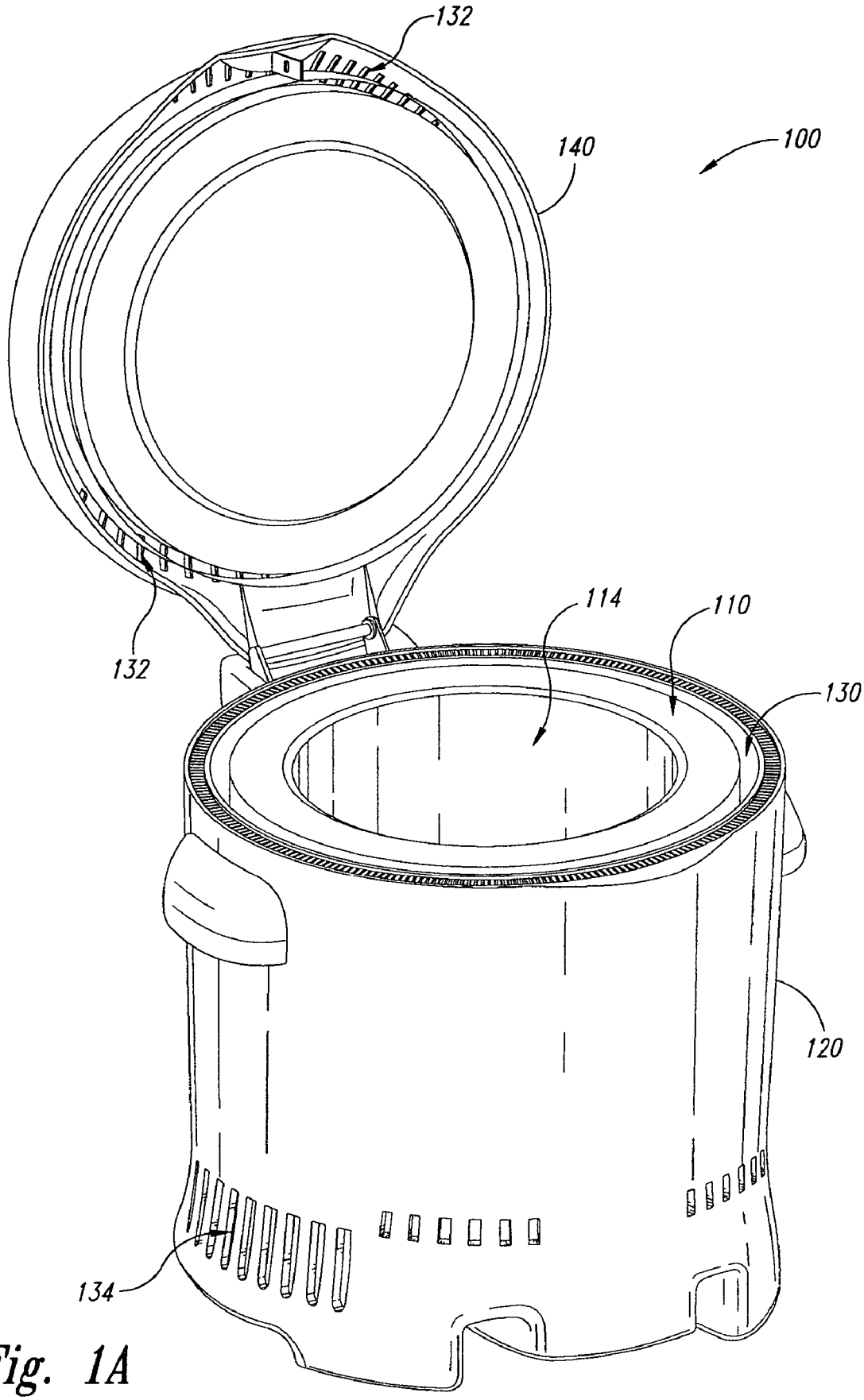
FIGS. 1A and 1B are isometric views of a kiln configured in accordance with an embodiment of the invention.
Figure 1B:
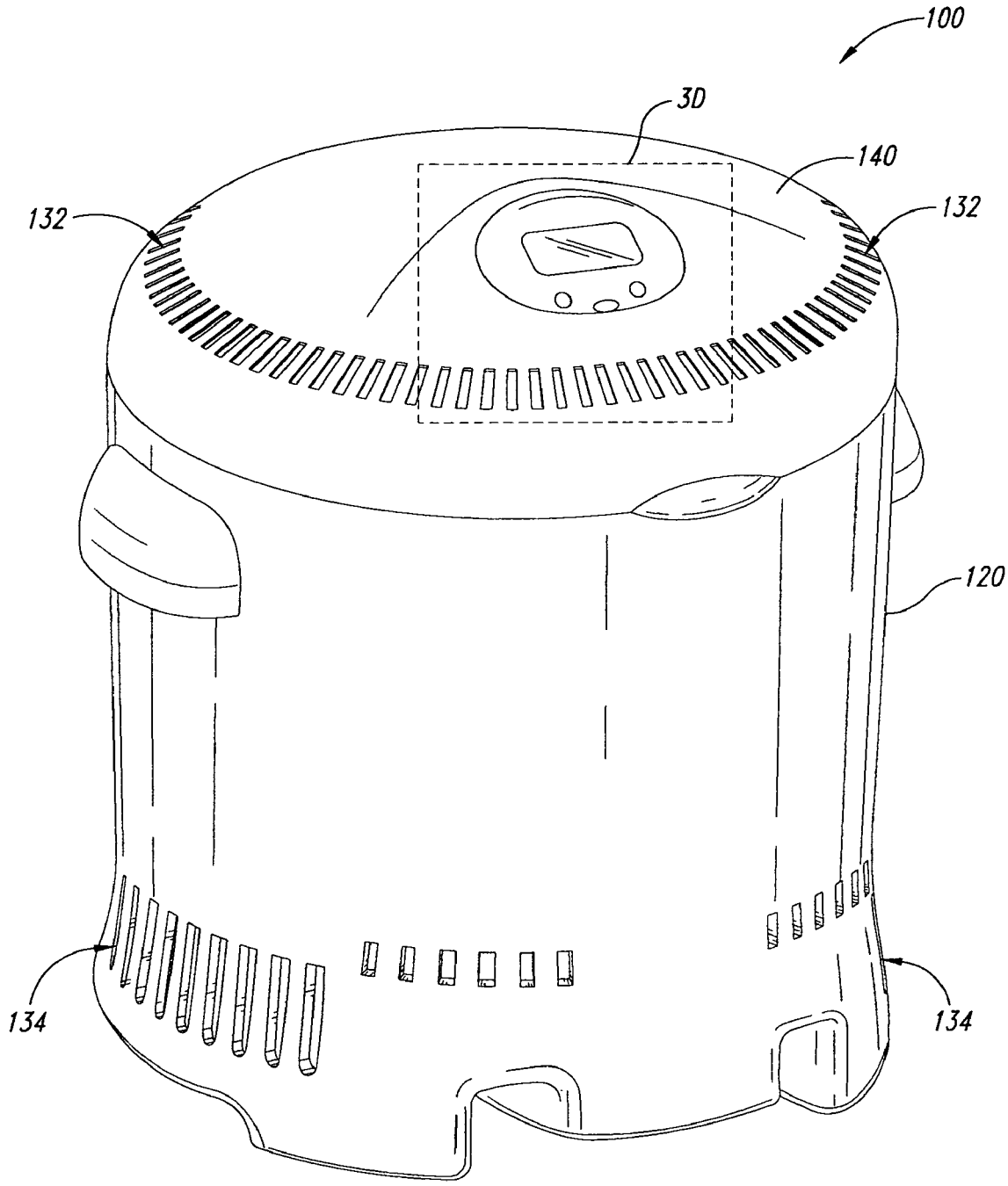

FIGS. 1A and 1B are isometric views of a kiln 100 configured in accordance with an embodiment of the invention. Referring to FIG. 1A, the kiln 100 can include an inner body 110 configured to hold one or more ceramic workpieces (not shown), and an outer body 120 at least partially surrounding the inner body 110. The outer body 120 is spaced apart from the inner body 110 to define an airflow passageway 130 therebetween. The kiln 100 can further include a lid assembly 140 pivotably coupled to the outer body 120. The lid assembly 140 can be configured to sealably close against the inner body 110 and, in at least several embodiments, the outer body 120. In FIG. 1A, the lid assembly 140 is illustrated in an open position to provide access to a processing chamber 114. In FIG. 1B the lid assembly 140 is sealably closed against the inner body 110 and at least a portion of the outer body 120 for workpiece processing.

Referring to FIGS. 1A and 1B together, the kiln 100 includes an air inlet 132 in the lid assembly 140 and an air outlet 134 in the outer body 120. The inlet 132 and outlet 134 are in fluid communication with the airflow passageway 130 (FIG. 1A). As described in detail below with reference to FIG. 2, the kiln 100 further includes an air mover configured to move ambient air through the airflow passageway 130 from the inlet 132 toward the outlet 134 to maintain the surface temperature of the outer body 120 at or below a preset temperature during operation of the kiln 100. For example, in one embodiment, the surface temperature of the outer body 120 can remain cool to the touch, while the processing chamber 114 is heated to over 1800° F. for workpiece processing. Various features of several embodiments of the system for cooling the inner body 110 are described in greater detail below with reference to FIGS. 2-5.

Figure 2:
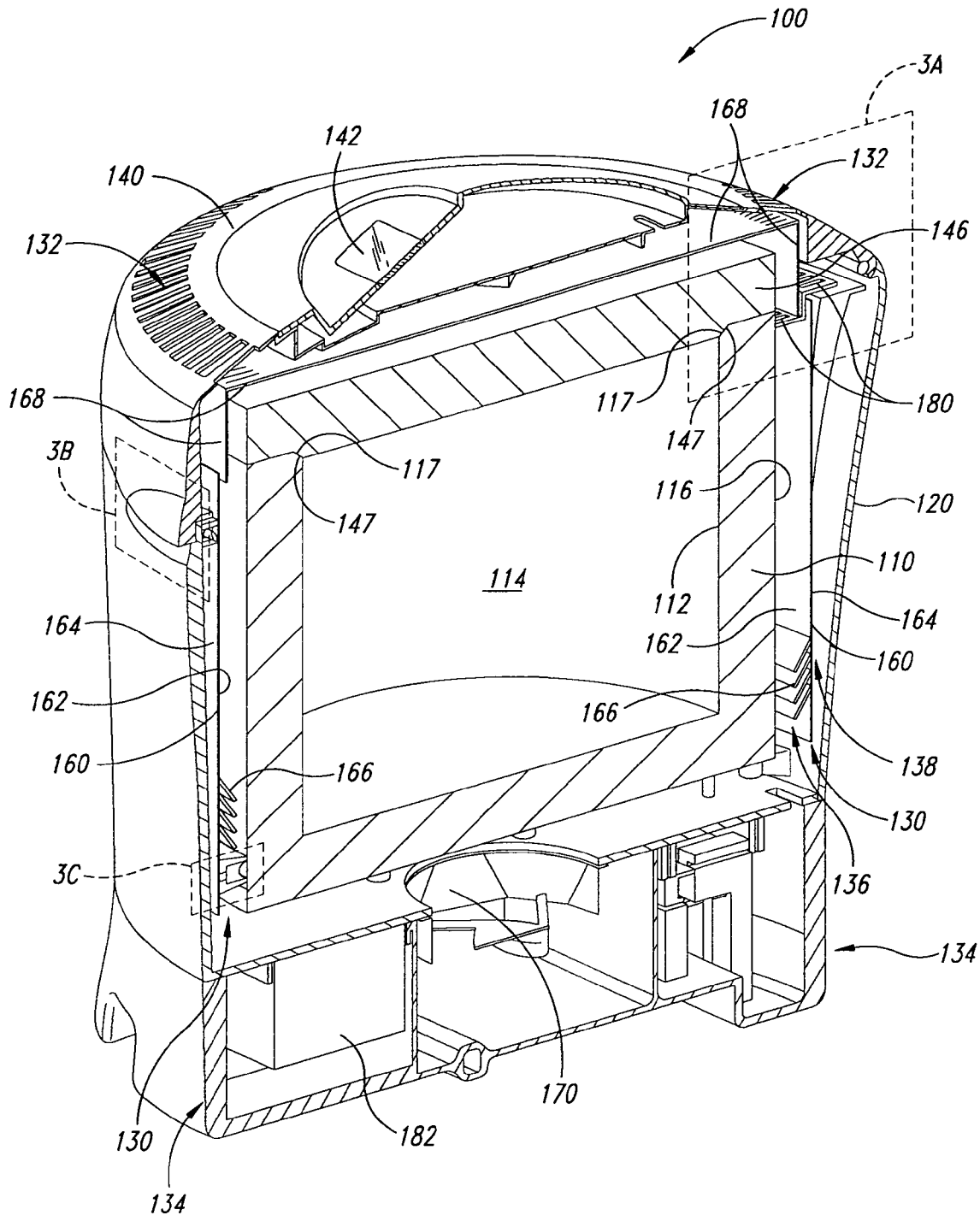
FIG. 2 is an isometric cross-sectional view of the kiln of FIGS. 1A and 1B.

FIG. 2 is an isometric cross-sectional view of the kiln 100 of FIGS. 1A and 1B. The inner body 110 includes an inner wall 112 defining the processing chamber 114 for ceramic workpieces (not shown). The inner body 110 further includes an outer wall 116 that faces the outer body 120. The inner body 110 can include a refractory material that is configured to withstand the high temperatures necessary to process the ceramic workpiece and the drastic changes in temperature throughout the processing cycle. The thickness of the inner body 110 (i.e., the distance between the inner wall 112 and the outer wall 116) can vary depending on the desired operational parameters for the kiln 100 and/or the material used to form the inner body 110.

The lid assembly 140 further includes an inner body lid portion 146 configured to releasably engage or otherwise mate with the inner body 110 to sealably close the processing chamber 114. In the illustrated embodiment, the inner body lid portion 146, can include a first chamfered portion 147 configured to mate with a second chamfered portion 117 of the inner body 110 to seal the processing chamber 114 when the lid assembly 140 is closed (as illustrated in FIG. 2). One advantage of the relatively large surface area of the interface between the sidewall of the inner body 110 and the inner body lid portion 146 is that the chamfered interface can minimize heat loss from the processing chamber 114 during operation as compared with processing chambers that include non-chamfered interfaces. In a further aspect of this embodiment, the inner body lid portion 146 carried by the lid assembly 140 can be slightly adjustable (e.g., it can "float" or move horizontally and/or vertically) relative to the lid assembly 140 and the inner body 110, thereby allowing the first chamfered interface portion 147 of the inner body lid portion 146 to more accurately and tightly seat against the second chamfered interface portion 117 of the inner body 110.

In another aspect of this embodiment, the kiln 100 includes a first radiant barrier 160 positioned in the airflow passageway 130 between the inner body 110 and the outer body 120, and a second radiant barrier 168 carried by the lid assembly 140. The first radiant barrier 160 can include a first side 162 facing the outer wall 116 of the inner body 110 and a second side 164 facing the outer body 120. The first radiant barrier 160 defines (a) a first portion 136 of the airflow passageway 130 between the inner body 110 and the first side 162 of the first radiant barrier 160, and (b) a second portion 138 of the airflow passageway 130 between the second side 164 of the first radiant barrier 160 and the outer body 120. Further details regarding the first and second portions 136 and 138 of the airflow passageway 130 are described below with respect to FIG. 5. The second radiant barrier 168 is spaced apart from the inner body lid portion 146.

In one embodiment, the first side 162 of the first radiant barrier 160 and the lower side of the second radiant barrier 168 facing the inner body lid portion 146 can each include a polished, highly reflective surface. One advantage of this feature is that the reflective surface can help maintain the temperature of the outer body 120 at an acceptable level by reflecting heat from the inner body 110 back toward the inner body during kiln operation. The first radiant barrier 160 can also include a plurality of fins 166 projecting from the first side 162 of the first radiant barrier 160 toward the outer wall 116 of the inner body 110. The fins 166 are positioned to create an area of low pressure within the first portion 136 of the airflow passageway 130 to help increase the flow of air within this portion of the airflow passageway 130. In other embodiments, the first and second radiant barriers 160 and 168 can include different features and/or have other arrangements depending on a number of different factors including manufacturing cost, operating temperatures, etc.

As mentioned previously, the kiln 100 includes an air mover 170 (e.g., a fan) positioned to move air through the airflow passageway 130 from the inlet 132 toward the outlet 134. In the embodiment illustrated in FIG. 2, the air mover 170 is located proximate to a lower portion of the kiln 100 in communication with the airflow passageway 130. In other embodiments, however, the air mover 170 can be positioned at different locations and/or have different configurations. In several embodiments, the kiln 100 can further include a battery 182 operably coupled to the air mover 170 and/or other kiln systems (not shown). The battery 182 is configured to power the air mover 170 and various controls of the kiln 100 in the event of an external power failure while the kiln 100 is processing the ceramic workpiece. In this regard, the battery 182 is a back-up feature that allows the air mover 170 to continue cooling the inner body 110 and maintain the outer body 120 at or below a preset temperature until processing is complete.

In still another aspect of this embodiment, the kiln 100 can include a debris screen 180 positioned proximate to the inlet 132 of the airflow passageway 130. The debris screen 180 includes a number of apertures configured to allow air to pass, but prevents large particulates or other undesirable materials from entering the airflow passageway 130. In other embodiments, the debris screen 180 may have a different configuration or be positioned at a different location. In still other embodiments, the debris screen 180 can be omitted.

Figure 3A:
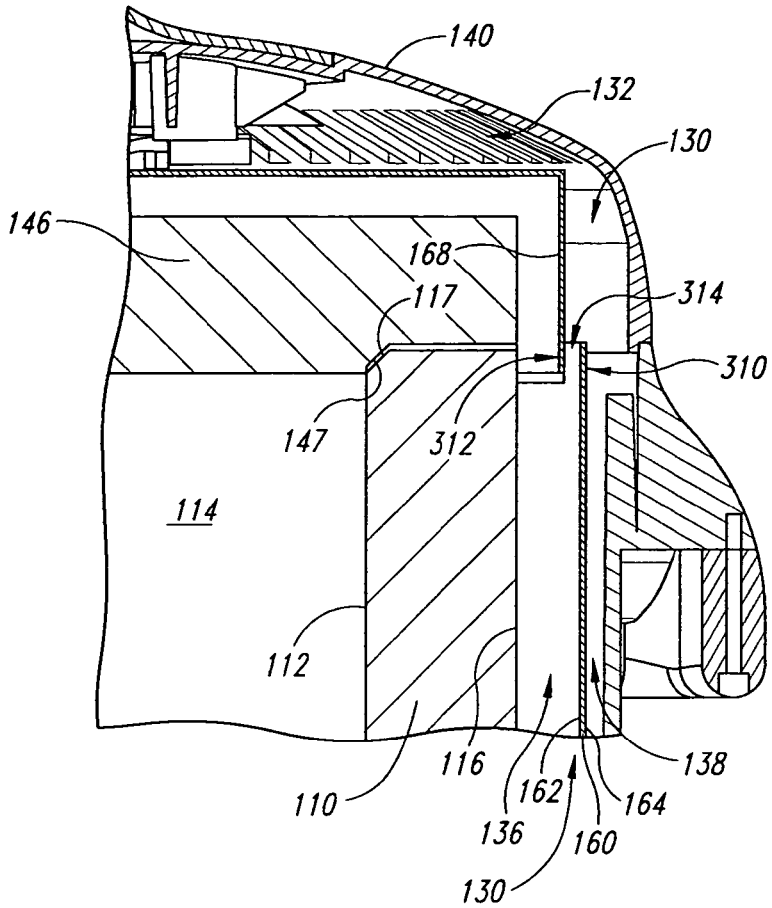
FIG. 3A is an enlarged, side cross-sectional view taken from the area 3A of FIG. 2 illustrating several aspects of the invention.

FIG. 3A is an enlarged, side cross-sectional view taken from the area 3A of FIG. 2 illustrating several aspects of the invention. As this view illustrates, the first radiant barrier 160 includes an upper edge portion 310, and the second radiant barrier 168 includes a lower edge portion 312 spaced apart from the upper edge portion 310 to define an offset 314 between the two structures. The offset 314 is configured to cause additional ambient air to flow into the first portion 136 of the airflow passageway 130 to further cool the inner body 110 during kiln operation. In other embodiments, the offset 314 can have a different arrangement and/or dimension or be omitted.

Figure 3B:
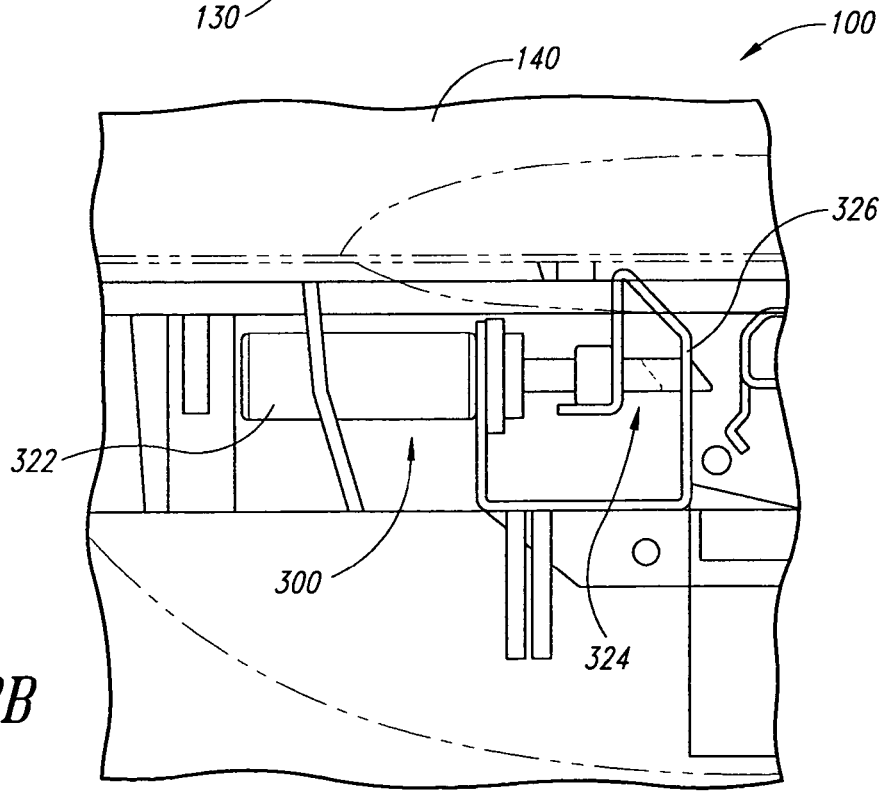
FIG. 3B is an enlarged, side cross-sectional view taken from the area 3B of FIG. 2 illustrating other aspects of the invention.

FIG. 3B is an enlarged, side cross-sectional view taken from the area 3B of FIG. 2 illustrating another aspect of the invention. In this embodiment, the kiln 100 includes a latch assembly 320 configured to releasably secure the lid assembly 140 in a closed position during processing. The latch assembly 320 can include, for example, a solenoid mechanism 322 to toggle a pin 324 between an unlocked position (shown in broken lines) and a locked position (shown in solid lines). In the locked position, the pin 324 engages a catch 326 to restrain the lid assembly 140 in a closed position. The latch assembly 320 can be operably coupled to a controller (not shown) that causes the pin 324 to remain in the locked position while the kiln 100 is operational (e.g., when the temperature in the processing chamber 114 is above a preset temperature, such as 130° F.). In other embodiments, the latch assembly 320 can have a different configuration (e.g., the latch assembly may have a generally vertical orientation rather than the generally horizontal orientation in the illustrated embodiment) and/or the latch assembly 320 may include different features.

Figure 3C:
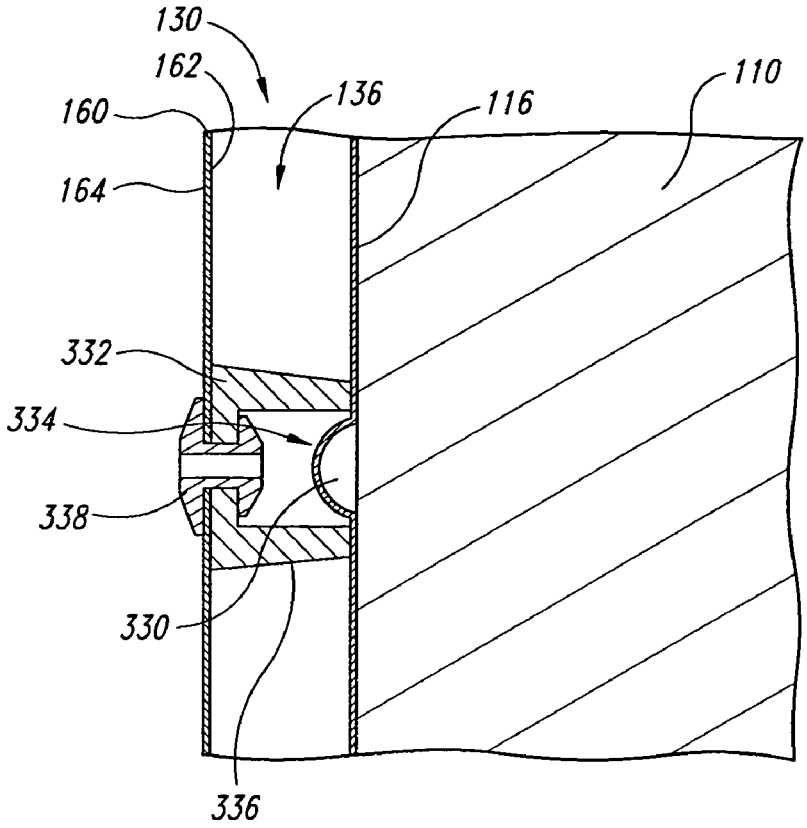
FIG. 3C is an enlarged, side cross-sectional view taken from the area 3C of FIG. 2 illustrating further aspects of the invention.

FIG. 3C is an enlarged, side cross-sectional view taken from the area 3C of FIG. 2 illustrating one method for attaching the inner body 110 to the first radiant barrier 160. In the illustrated embodiment, the inner body 110 includes a plurality of protrusions or dimples 330 (only one is shown) projecting away from the outer wall 116 of the inner body 110 toward the first side 162 of the first radiant barrier 160. A plurality of spacers 332 (only one is shown) can be engaged with corresponding protrusions 330 to releasably attach the inner body 110 to the first radiant barrier 160. Each spacer 332 can include, for example, a generally cylindrical riser portion 336 at least partially surrounding the corresponding protrusion 330 and an engagement feature 334 configured to mate with or otherwise engage the protrusion 330. The riser portion 336 can be formed from a material that generally prevents thermal transfer between the inner body 110 and the first radiant barrier 160. The riser portion 336 can be releasably secured to the first radiant barrier 160 with a fastener 338. An advantage of this feature is that the spacer 332 is configured to allow some minor relative movement between the inner body 110 and the first radiant barrier 160 during processing, while preventing thermal transfer between the two structures.

Figure 3D:
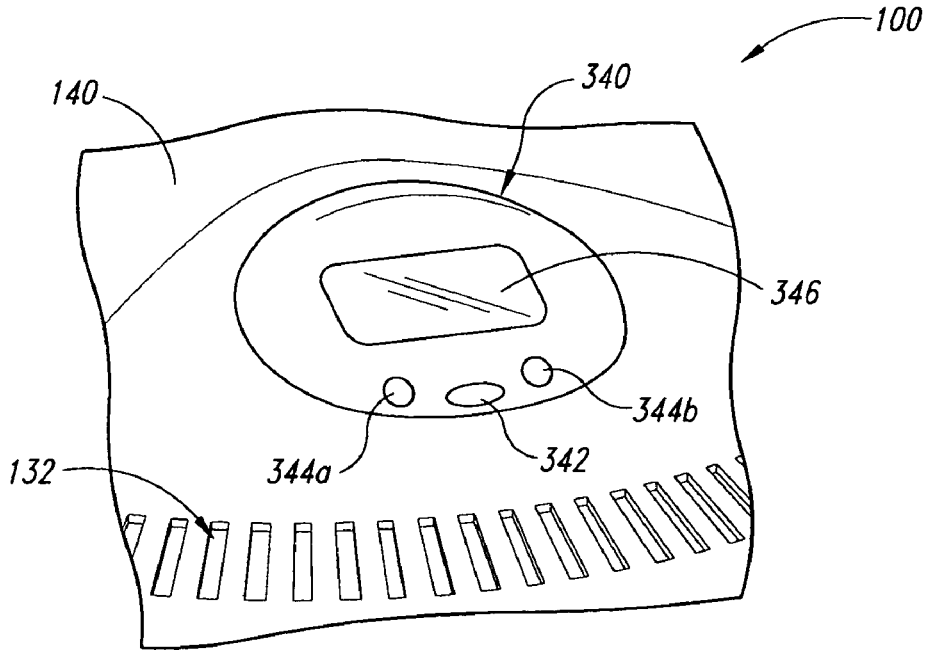
FIG. 3D is an enlarged, isometric view taken from the area 3D of FIG. 1B illustrating yet another aspect of the invention.

FIG. 3D is an enlarged isometric view taken from the area 3D of FIG. 1B illustrating still another aspect of the invention. As this view illustrates, the lid assembly 140 can include a user interface 340 for controlling operation of the kiln 100. The user interface 340 can include, for example, a power button 342 to power the kiln 100 on and off and one or more selector buttons 344 (two are shown in FIG. 1B as 344*a* and 344*b*) to activate various functions of the kiln 100, such as starting/canceling the glazing process and unlocking the lid assembly 140. The user interface 340 further includes a display 346 to provide feedback to the user regarding the current operational status of the kiln 100, such as temperature, time, etc. In other embodiments, the user interface 340 can include different features and/or the features may have a different arrangement.

Figure 4A:
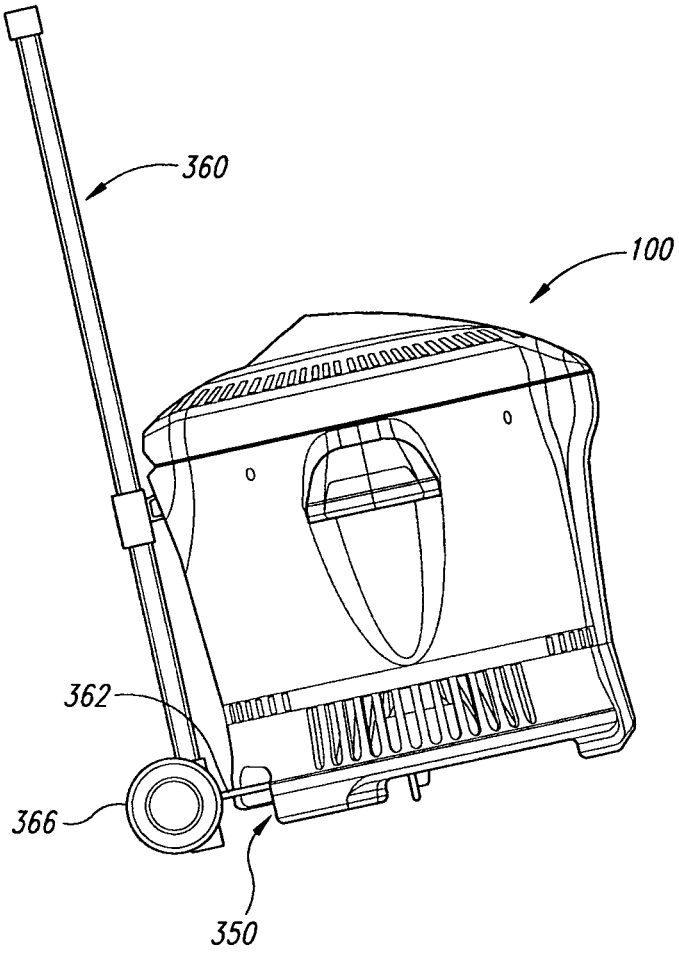
FIG. 4A is a side view and FIG. 4B is a bottom isometric view of the kiln of FIGS. 1A-3D and a kiln transport assembly configured in accordance with an embodiment of the invention.
Figure 4B:
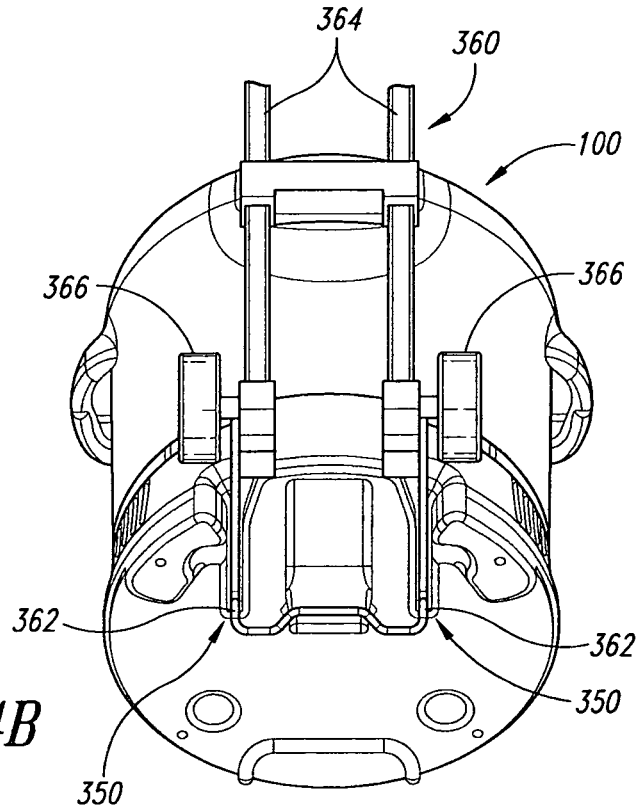

FIG. 4A is a side view and FIG. 4B is a bottom isometric view of the kiln of FIGS. 1A-3D and a kiln transport assembly 360 configured in accordance with an embodiment of the invention. Referring to FIGS. 4A and 4B together, the kiln 100 includes an interface portion 350 configured to releasably receive a portion of the kiln transport assembly 360. In the illustrated embodiment, for example, the kiln transport assembly 360 is a hand truck with engagement members 362 received within the interface portion 350 of the kiln, a vertical frame 364 with one or more handles at an upper portion of the frame 364, and a set of wheels 366. Using the kiln transport assembly 360, a user (not shown) can readily move the kiln 100 from one location to another location either before or after processing. Compared with the large and relatively cumbersome conventional kilns described previously, the kiln 100 can be relatively easy to move from one location to another. Additionally, during normal operation of the kiln 100, the kiln transport assembly 360 can be disengaged from the kiln 100 and stored separately. In other embodiments, the kiln 100 may include one or more sets of wheels attached to the outer body 120 in addition to (or in lieu of) the wheels 366 of the kiln transport assembly 360. In still further embodiments, the kiln 100 can include a permanent or at least partially permanent transport assembly rather than the removable kiln transport assembly 360 described above.

Figure 5:
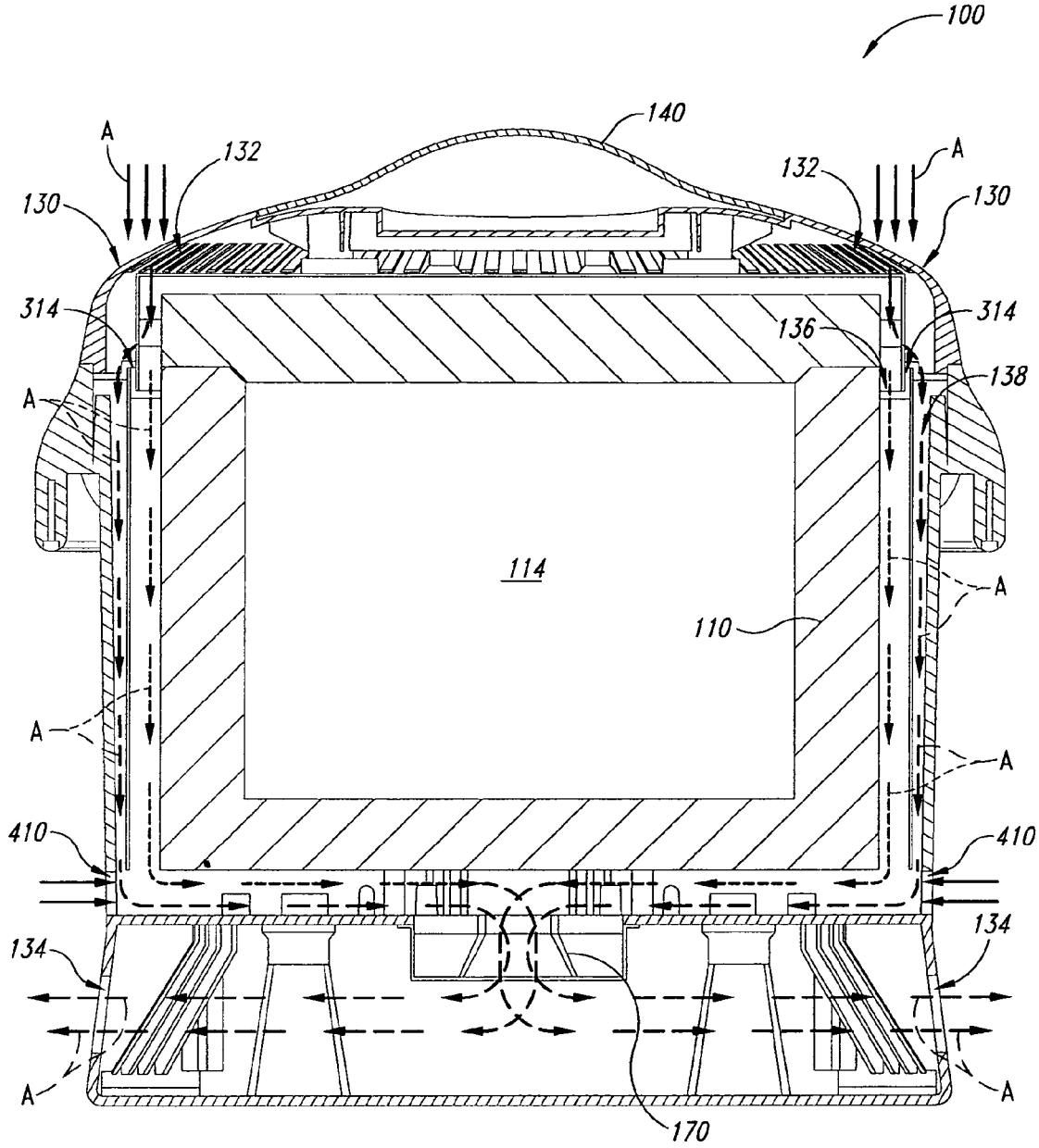
FIG. 5 is a side cross-sectional view of the kiln of FIGS. 1A-3D illustrating various aspects of several embodiments for cooling the kiln during operation.

FIG. 5 is a side cross-sectional view of the kiln 100 of FIGS. 1A-3D illustrating various functional aspects of the kiln during operation. In the illustrated embodiment, the air mover 170 is configured to move ambient air (as shown by the arrows A) through the airflow passageway 130 from the inlet 132 toward the outlet 134. More specifically, after passing through the inlet 132, the air flow A moves into both the first portion 136 and the second portion 138 of the airflow passageway 130. The first portion 136 of the airflow passageway 130 is closer in proximity to the inner body 110 than the second portion 138 and, therefore, the first portion 136 of the airflow passageway 130 is generally at a higher temperature than the second portion 138 of the airflow passageway. The air flow A passing through the first portion 136 is accordingly heated to a higher temperature than the air flow A passing through the second portion 138 of the airflow passageway.

In one aspect of this embodiment, the offset 314 (discussed in detail above with respect to FIG. 3A) is configured to increase or supplement the flow of cooler ambient air into the first portion 136 of the airflow passageway 130 to help cool the inner body 110. In another aspect of this embodiment, the kiln 100 can further include a plurality of supplemental air intake portions 410 in the outer body 120 and generally aligned with a lower portion of the inner body 110. The air intake portions 410 are in fluid communication with the airflow passageway 130. In operation, an additional volume of cooler ambient air can flow through the air intake portions 410 into the airflow passageway 130 and mix with the exhaust air passing out of the first and second portions 136 and 138 of the airflow passageway 130 and toward the air mover 170. In this way, the air flow A is cooled before being exhausted from the outlet portions 134.

One feature of at least some of the embodiments of the kiln 100 described above with respect to FIGS. 1A-5 is that the outer body 120 of the kiln 100 is kept relatively cool during operation. One advantage of this feature is that the kiln 100 can be used in a variety of environments (e.g., home or personal use) where higher temperatures would be undesirable. In contrast, as discussed above, the exterior surfaces of conventional kilns can become relatively hot during operation and, accordingly, such kilns are generally unsuitable for home use.

Another feature of at least some of the embodiments of the kiln 100 described above is that the kiln is portable and relatively small as compared with conventional kilns. For example, the kiln transport assembly 360 can be used to move the kiln 100 from a first location to a second location with relative ease. Still another feature of at least some embodiments of the kiln 100 is the relatively small size of the kiln as compared with conventional kilns. An advantage of these features is that it can reduce the time and cost associated with the production and processing of ceramic articles because a user can perform the firing processes at home using the kiln 100, rather than having to take the ceramic articles to be processed in a commercial-grade kiln.

From the foregoing, it will be appreciated that specific embodiments of the invention have been described herein for purposes of illustration, but that various modifications may be made without deviating from the invention. For example, the kiln can include a different number of air movers and/or the air movers may be positioned at different locations within the kiln. Additionally, in several embodiments the kiln 100 can be configured to process glass, jewelry, and/or other related materials in addition to (or in lieu of) ceramic materials. Aspects of the invention described in the context of particular embodiments may be combined or eliminated in other embodiments. Further, while advantages associated with certain embodiments of the invention have been described in the context of those embodiments, other embodiments may also exhibit such advantages, and not all embodiments need necessarily exhibit such advantages to fall within the scope of the invention. Accordingly, the invention is not limited except as by the appended claims.

We claim:

1. A kiln, comprising:

an inner body configured to hold one or more ceramic workpieces for processing;

an outer body at least partially surrounding the inner body and spaced apart from the inner body to define an airflow passageway therebetween, the airflow passageway having an inlet proximate to an upper portion of the outer body and an outlet proximate to a lower portion of the outer body;

a lid assembly pivotably coupled to the outer body and configured to sealably close against at least the inner body;

a radiant barrier positioned in the airflow passageway between the inner body and the outer body, the radiant barrier including a first side facing the inner body and a second side facing the outer body; and an air mover positioned to move ambient air through the airflow passageway from the inlet toward the outlet.

2. The kiln of claim 1 wherein the lid assembly includes at least a portion of the inlet of the airflow passageway.

3. The kiln of claim 1, further comprising a latch assembly configured to releasably secure the lid assembly in a closed position when the temperature in the inner body is above a preset temperature.

4. The kiln of claim 1 wherein:

the lid assembly has a first chamfered interface portion; and the inner body has a second chamfered interface portion configured to cooperate with the first chamfered interface portion to seal the inner body when the lid assembly is closed.

5. The kiln of claim 1 wherein the radiant barrier defines (a) a first portion of the airflow passageway between the inner body and the first side of the radiant barrier, and (b) a second portion of the airflow passageway between the second side of the radiant barrier and the outer body.

6. The kiln of claim 5 wherein the first portion of the airflow passageway operates at a first temperature and the second portion of the airflow passageway operates at a second temperature less than the first temperature.

7. The kiln of claim 1 wherein the inlet is a first inlet and the radiant barrier is a first radiant barrier, and wherein the kiln further comprises:

a second radiant barrier carried by the lid assembly, wherein the second radiant barrier is laterally offset from the first radiant barrier when the lid assembly is closed to define a second inlet positioned to draw additional air into the airflow passageway.

8. The kiln of claim 1 wherein the inlet is a first inlet and the radiant barrier is a first generally cylindrical radiant barrier having a first diameter, and wherein the kiln further comprises:

a second generally cylindrical radiant barrier carried by the lid assembly, the second radiant barrier having a second diameter less than the first diameter to define a second inlet positioned to draw additional air into the airflow passageway when the lid assembly is closed.

9. The kiln of claim 1 wherein the radiant barrier further comprises a plurality of fins projecting from the first side of the radiant barrier toward the inner body.

10. The kiln of claim 1 wherein the first side of the radiant barrier includes a highly reflective surface.

11. The kiln of claim 1 wherein the inner body comprises a refractory portion.

12. The kiln of claim 1 wherein the outer body is configured to releasably receive a kiln transport assembly.

13. The kiln of claim 1 wherein the air mover is positioned proximate to the lower portion of the outer body.

14. The kiln of claim 13 wherein the air mover is centrally located beneath the inner body.

15. The kiln of claim 1, further comprising a plurality of air intake portions in the outer body adjacent to a lower portion of the inner body, the air intake portions being in fluid communication with the airflow passageway.

16. The kiln of claim 1, further comprising a debris screen positioned proximate the inlet of the airflow passageway.

17. A portable kiln, comprising:

an inner body configured to hold one or more ceramic workpieces for processing;

an outer body at least partially surrounding the inner body and spaced apart from the inner body to define an airflow passageway therebetween, the airflow passageway having an inlet proximate to an upper portion of the outer body and an outlet proximate to a lower portion of the outer body;

a lid assembly operably coupled to the outer body and configured to sealably close against at least the inner body;

a radiant barrier positioned in the airflow passageway between the inner body and the outer body; and a fan proximate to the lower portion of the outer body and positioned to move ambient air through the airflow passageway from the inlet toward the outlet to cool the inner body during processing of the one or more ceramic workpieces placed therein.

18. The portable kiln of claim 17 wherein the lid assembly includes at least a portion of the inlet of the airflow passageway.

19. The portable kiln of claim 17 wherein:

the lid assembly has a first chamfered portion; and the inner body has a second chamfered portion configured to cooperate with the first chamfered portion to seal the inner body when the lid assembly is closed.

20. The portable kiln of claim 17 wherein:

the lid assembly includes a lower edge portion and a first chamfered portion at the lower edge portion; and the inner body includes a sidewall having an upper edge portion and a second chamfered portion at the upper edge portion, the second chamfered portion being configured to cooperate with the first chamfered portion to seal the inner body when the lid assembly is closed.

21. The portable kiln of claim 17, further comprising a latch assembly configured to releasably secure the lid assembly in a closed position when the temperature in the inner body is above a preset temperature.

22. The portable kiln of claim 17 wherein the radiant barrier includes a first side facing the inner body and a second side facing the outer body, the radiant barrier defining (a) a first portion of the airflow passageway between the inner body and the first side of the radiant barrier, and (b) a second portion of the airflow passageway between the second side of the radiant barrier and the outer body.

23. The portable kiln of claim 22 wherein the first portion of the airflow passageway operates at a first temperature and the second portion of the airflow passageway operates at a second temperature less than the first temperature.

24. The portable kiln of claim 17 wherein the inlet is a first inlet and the radiant barrier is a first radiant barrier, and wherein the kiln further comprises:

a second radiant barrier carried by the lid assembly, wherein the second radiant barrier is laterally offset from the first radiant barrier when the lid assembly is closed to thereby define a second inlet positioned to draw additional air into the airflow passageway to cool the inner body.

25. The portable kiln of claim 17 wherein the first side of the radiant barrier has a first level of reflectivity and the second side has a second level of reflectivity less than the first level.

26. The kiln of claim 17 wherein the outer body includes an interface portion configured to receive a portion of a kiln transport assembly.

27. The kiln of claim 17 wherein the outer body includes one or more channels configured to releasably receive an engagement member of a kiln transport assembly.

28. A portable kiln, comprising:

a ceramic processing chamber;

an outer body at least partially surrounding the processing chamber and spaced apart from the processing chamber to define an airflow passageway therebetween, the airflow passageway having an air inlet proximate to an upper portion of the outer body and an air outlet proximate to a lower portion of the outer body;

a lid assembly pivotably coupled to the outer body and configured to sealably close against at least the processing chamber;

radiant barrier means for dividing the airflow passageway between the processing chamber and the outer body; and airflow means for moving ambient air through the airflow passageway from the air inlet toward the air outlet to cool the processing chamber.

29. The kiln of claim 28 wherein the radiant barrier means for dividing the airflow passageway includes a first side facing the processing chamber and a second side facing the outer body, the radiant barrier means defining (a) a first portion of the airflow passageway between the processing chamber and the first side of the radiant barrier means, and (b) a second portion of the airflow passageway between the second side of the radiant barrier means and the outer body.

30. The kiln of claim 29 wherein the first portion of the airflow passageway operates at a first temperature and the second portion of the airflow passageway operates at a second temperature less than the first temperature.

31. The kiln of claim 28 wherein the airflow means includes a fan proximate to the lower portion of the outer body and positioned to move air through the airflow passageway from the air inlet toward the air outlet.

32. A method for processing a ceramic workpiece in a processing chamber of a kiln, the method comprising:

increasing a temperature in the processing chamber to process the ceramic workpiece;

reflecting at least a portion of the heat generated by the processing chamber during processing back toward the inner body using a radiant barrier positioned in the airflow passageway; and flowing ambient air from an inlet positioned proximate to an upper portion of the kiln through a passageway extending at least partially around the processing chamber to maintain the temperature of an exterior portion of the kiln at or below a preset temperature.

33. The method of claim 32 wherein increasing the temperature within processing chamber includes increasing the temperature to about 1800 degrees Fahrenheit or more.

34. The method of claim 32, further comprising exhausting the air through an outlet positioned proximate to a lower portion of the kiln.

35. The method of claim 32, further comprising:

releasably engaging a kiln transport assembly with an outer body of the kiln;

moving the kiln from a first location to a second location; and removing the kiln transport assembly from the outer body of the kiln.

36. The method of claim 32 wherein the airflow passageway includes a first portion of the airflow passageway between the outer wall of the processing chamber and the radiant barrier and a second portion of the airflow passageway between the radiant barrier and an outer body of the kiln, and wherein the method further comprises:

flowing air through both the first portion of the airflow passageway and the second portion of the airflow passageway.

37. A kiln, comprising:

an inner body configured to hold one or more ceramic workpieces for processing;

an outer body at least partially surrounding the inner body and spaced apart from the inner body to define an airflow passageway therebetween, the airflow passageway having an inlet proximate to an upper portion of the outer body and an outlet proximate to a lower portion of the outer body;

a plurality of air intake portions in the outer body adjacent to a lower portion of the inner body, the air intake portions being in fluid communication with the airflow passageway;

a lid assembly pivotably coupled to the outer body and configured to sealably close against at least the inner body; and an air mover positioned to move ambient air through the airflow passageway from the inlet toward the outlet.

* * * * *

UNITED STATES PATENT AND TRADEMARK OFFICE

CERTIFICATE OF CORRECTION

PATENT NO. : 7,780,439 B2
APPLICATION NO. : 11/280953
DATED : August 24, 2010
INVENTOR(S) : Ehsan Alipour et al.

It is certified that error appears in the above-identified patent and that said Letters Patent is hereby corrected as shown below:

On the title page, item (54), in "Title", in column 1, line 1, after "FOR" delete "THE".

In column 1, line 1, after "FOR" delete "THE".

Signed and Sealed this

Thirtieth Day of November, 2010

David J. Kappos

David J. Kappos
*Director of the United States Patent and Trademark Office*